United States Patent [19]

Reed

[11] Patent Number: 4,630,425

[45] Date of Patent: Dec. 23, 1986

[54] ERECTION MEANS FOR PORTABLE DRILLING SYSTEM

[75] Inventor: Lowell M. Reed, Oklahoma City, Okla.

[73] Assignee: Parker Drilling Company, Tulsa, Okla.

[21] Appl. No.: 799,553

[22] Filed: Nov. 19, 1985

Related U.S. Application Data

[60] Continuation of Ser. No. 649,929, Sep. 13, 1984, abandoned, which is a division of Ser. No. 261,902, May 8, 1981, Pat. No. 4,473,977.

[51] Int. Cl.[4] ..... B66C 27/06

[52] U.S. Cl. ..... 52/745

[58] Field of Search ..... 52/116–120, 52/111, 741

[56] References Cited

U.S. PATENT DOCUMENTS

| | | | |
|---|---|---|---|
| 2,261,013 | 10/1941 | Berby | 52/116 |
| 3,228,151 | 1/1966 | Wadslayer | 52/64 |
| 3,262,237 | 7/1966 | Jenkins | 52/116 |
| 3,483,933 | 12/1969 | Dyer | 52/116 |
| 3,749,183 | 7/1973 | Branham | 52/116 |
| 3,803,780 | 4/1974 | Donnally | 52/116 |
| 4,221,088 | 9/1980 | Patterson | 52/116 |
| 4,305,237 | 12/1981 | Borg | 52/116 |

FOREIGN PATENT DOCUMENTS

| | | | |
|---|---|---|---|
| 909959 | 5/1965 | United Kingdom | 52/116 |

*Primary Examiner*—Henry E. Raduazo

*Attorney, Agent, or Firm*—Head, Johnson & Stevenson

[57] ABSTRACT

A portable apparatus for drilling deep boreholes in the earth, comprising a sub-base structure, a drawworks platform supported on four legs hinged both to the sub-base structure and to the drawworks platform and when in lowered position extends away from a first end of the sub-base: A mast hinged to the sub-base structure by two legs and in the lowered position extends away from the second end of the sub-base; a pulling means has a sheave through which a slingline cable is passed, and the two ends of the cable are separately connected between the mast at a selected point, and a pulley mounted on the drawworks platform so that in one continuous pulling motion of the pulling means, the drawworks platform is first raised into vertical position, and then the mast is lifted until both parts are fully erected on the sub-base.

1 Claim, 9 Drawing Figures

ERECTION MEANS FOR PORTABLE DRILLING SYSTEM

This is a continuation application of Ser. No. 649,929, filed Sept. 13, 1984 and now abandoned, which is a division of Ser. No. 261,902 filed May 8, 1981, now U.S. Pat. No. 4,473,977.

BACKGROUND OF THE INVENTION

1. Field of the Invention

This invention lies in the field of borehole drilling machines, and more particularly, to portable rotary drilling machines and still more particularly, those which are used for very deep drilling in the earth.

2. Description of the Prior Art

There are many examples of rotary drilling systems which are intended to be disassembled into pieces which are not too heavy to be transported by common means over the road. At the site at which the drilling system is to be erected, the parts are assembled on the ground, and then by means of A-frames or separate cranes, each of the major parts are then lifted into position and attached to the base in order to be fully assembled and ready for drilling.

In this invention the major parts, such as the drawworks platform and the mast, can be erected using only the power of the drawworks without the aid of A-frames or cranes.

SUMMARY OF THE INVENTION

It is a primary object of this invention to provide a complete portable rotary drilling apparatus for deep drilling of oil wells, which comprises all of the conventional parts which are capable of being broken down into transportable sub-units and which can be laid out and assembled on the ground, and then lifted into fully operable erected position by using only the power of the drawworks.

These and other objects are realized and the limitations of the prior art are overcome in this invention by providing three principal components of the drilling system; namely, the subbase, the drawworks, and the mast—each of which can be transported by disassembling into selected units.

The subbase is first erected on a flat ground surface. The subbase is of the type which permits the mast and drawworks platform to be erected flat on the ground and then to be raised on legs which are hinged so that the individual parts can be raised to a vertical position. The drawworks is mounted on a platform which is supported on four legs which are of equal length, and are hinged both to the platform and to the subbase system, so that by means of a cable at a suitable angle the platform can be lifted and raised into a position with the drawworks in place on the platform and the legs vertically arranged. It is locked in this position ready for operation.

The mast is made by joining suitable units and is of of conventional construction having a crown block with suitable sheaves, etc.

Although a conventional subbase can be used, the type of subbase which is preferred is that which is described in U.S. Pat. Nos. 4,009,544 and 4,024,924 to Mr. T. B. Houck. The two back legs are hinged to support shoes on the subbase structure. In that position the front legs are then very close to the ground so that the mast can be assembled and worked on by men standing on the ground which makes it a very rapid and convenient way to assemble and disassemble the mast.

In this design, the important feature is that the mast is hinged in such a position that it is laid out extending away from one end of the subbase, while the drawworks platform is laid out on the ground with the legs extending in the opposite direction from the opposite end of the subbase. To erect the two parts, they are lifted and rotated above the hinged means until they both come to a vertical position substantially in contact with each other.

In the process of assembly, the drawworks, engines, etc. are mounted on the drawworks platform which is a matter of a few feet above the ground. After the mast is assembled, a fastline cable from the drum of the drawworks is run to the crown block assembly, and reeved through the sheaves on the crown block and on the travelling block. A sheave is hung by its shaft from the hook of the travelling block, and this serves as a pulling means by means of which the two major parts of the drilling system can be raised.

A slingline cable is passed through the sheave on the hook, through other sheaves mounted on both sides of the mast, then two corresponding sheaves on the sides of the drawworks platform, and then back to the mast where the ends are anchored at selected points on the two sides of the mast.

There are two posts, one on each side of the subbase, each carrying sheaves on top, so that the slingline will pass over these sheaves going to and coming from the sheaves on the drawworks platform. The sheaves on the two posts are at a selected elevation above the level of the sheaves on the drawworks platform so that when the fastline from the drawworks going to the crown blocked is reeled on the drum, the hook will be raised in the mast and will pull on the slingline. A tension will be placed in the slingline, by means of which the drawworks platform will be lifted and tilted towards the vertical, rotating about the hinged bottom ends of the legs until it is in a perpendicular position on the subbase, or base.

When the drawworks platform is raised into erected position, further pulling on the fastline will cause further pulling on the slingline, which will then exert a lifting force on the mast through the two points—one of which is the sheave on the sides of the mast, and the other two points on the sides are where the slingline is anchored to the mast. Thus by means of the two lines coming from the sheaves on the side of the drawworks platform, the mast is lifted, rotating about the hinges at the bottom of the back legs of the mast until the mast comes into a vertical position. The front two legs are then anchored by means of drive pins to the shoe on the subbase structure. Now the two major components, the drawworks platform which forms the working floor of the drilling system and the mast, are anchored in vertical positions.

After this is done, a setback platform is placed in position on the front side of the mast, which may be supported independently on legs directly to the subbase structure or attached to the front legs of the mast. The important features of this invention are that the two major parts of the system; namely, the drawworks platform and the mast, are independently supported on hinged legs which, when the parts are in the lowered position, extend in opposite directions from each other. In this position a cable between a pulling means attached to the mast which passes over a sheave to the drawworks platform will, in one continuous pulling operation, raise both the drawworks platform and the mast into vertical position without the aid of additional apparatus such as A-frames, cranes, etc.

BRIEF DESCRIPTION OF THE DRAWINGS

These and other objects and advantages of this invention and a better understanding of the principles and details of the invention will be evident from the following description, taken in conjunction with the appended drawings, in which.

DETAILED DESCRIPTION OF THE PREFERRED EMBODIMENT

Figure 1A:
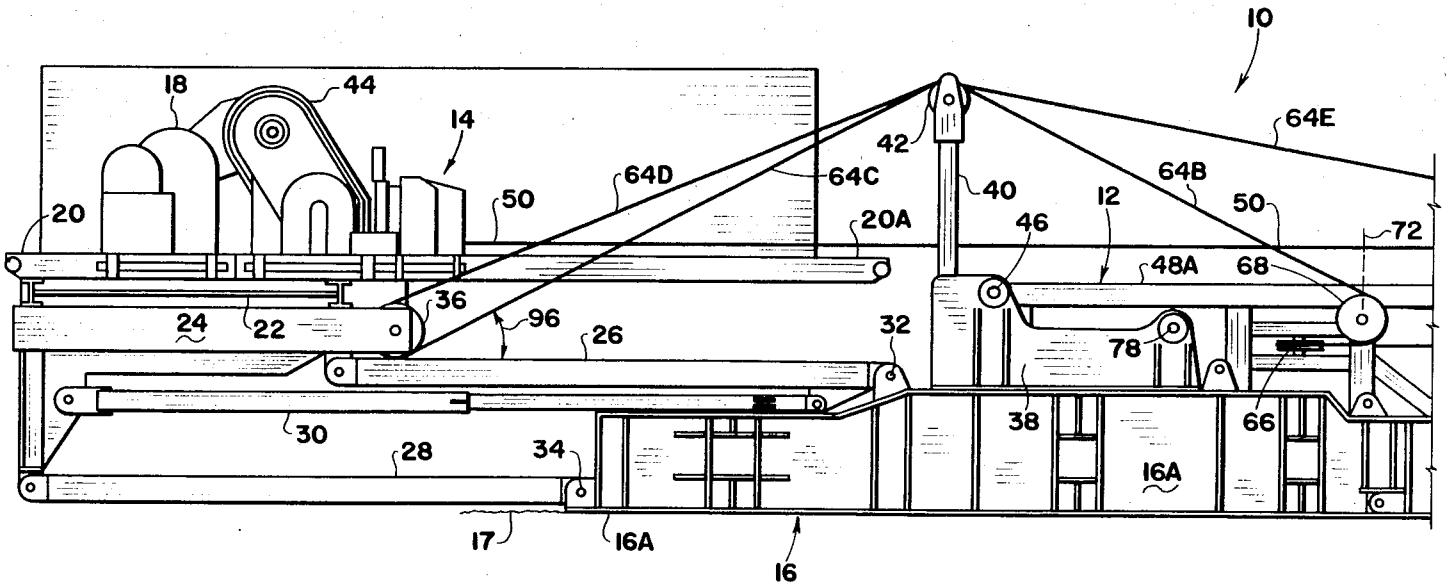
FIGS. 1A and 1B together illustrate in elevation the entire assembly on the ground of the subbase structure, the drawworks platform structure, and the mast, ready to be lifted into position.
Figure 1B:
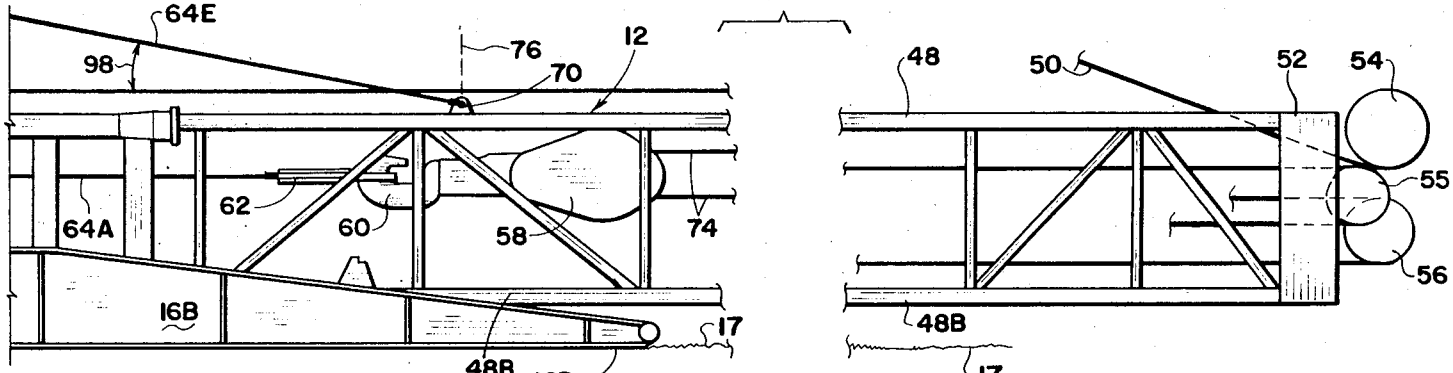

Referring now to the drawings and in particular to FIGS. 1A and 1B, there is shown in elevation the principal equipment of a portable drilling system, indicated generally by the numeral 10. It comprises a subbase 16, a mast structure 12, and a drawworks structure 14.

The subbase structure comprises a fabricated foundation for the drilling system which is made in a number of pieces which can be transported by truck over the road, and which when assembled on a flat surface of the ground can be locked together to form a single rigid subbase system.

The subbase system carries a mast shoe 38, which is a fabricated part of the base structure that has four pins 46 and 78 which will form the support for the mast in a raised position. It also has four pins in a suitable structure 32 and 34 for supporting the drawworks structure.

The drawworks structure 14 has a power unit 18 and a drum 44 of conventional design mounted on a skid 20 that has an extension floor 20A. The skid 20 is mounted on a suitable subfloor 22 which is then mounted on the drawworks platform 24.

Since the complete drilling structure, and particularly the mast, need lateral stability, the subbase structure is of substantial width and of substantial length, and both the drawworks assembly and the mast assembly are supported on four legs which are attached by drive pins into proper receptacles which are welded into the subbase structure.

Because of the symmetrical nature of the two sides, any elevational view will only show one side of each of the principal parts, and it is to be remembered that where the statement is made there are four legs supporting the drawworks platform, only two 26, 28 are shown, and it will be clear that there are two others hiding precisely behind the two that are shown. Similarly, while only two legs are shown—a back leg 48A and a front leg 48B, there are also two legs directly behind these that cannot be seen in the views of FIGS. 1A and 1B.

Figure 6:
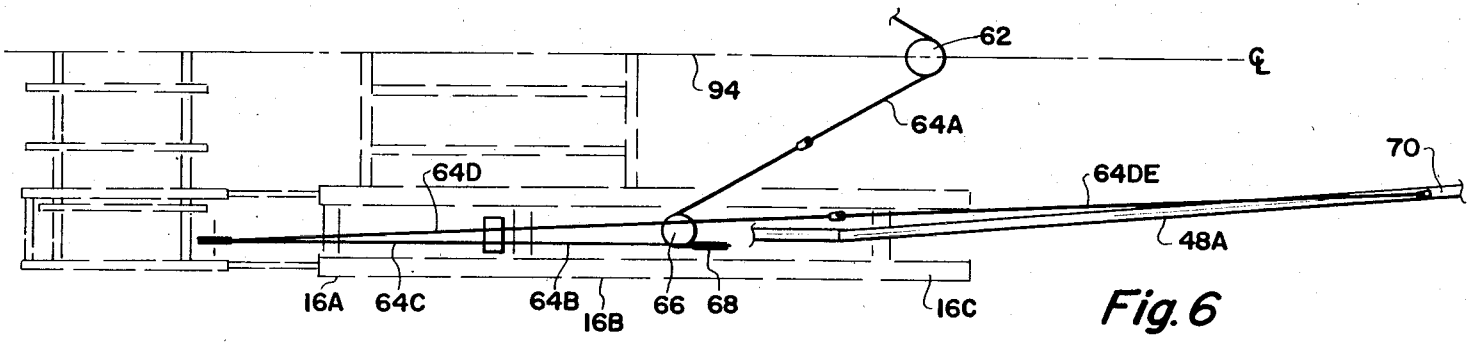
FIGS. 6 and 7 illustrate in plan view and in elevation the method of handling the slingline from the pulling means to both the drawworks platform and mast prior to lifting.

FIG. 6 is the only figure that shows in plan view any part of the apparatus. This will serve to illustrate at least one-half of the plan view of the drilling system. The other half is symmetrical.

After the subbase structure is assembled on the ground as shown in FIGS. 1A and 1B, the drawworks platform is positioned with the four legs 26 and 28 hinged at one end to appropriate pins in the drawworks platform and at the bottom ends to hinge points 32 and 34.

The drawworks 18, 44 is then assembled with its skid 20 on top of the platform 24 by a sub-means 22. In addition to the four legs 26 and 28, there is a pair of telescoping braces 30 that are fastened at one end to the drawworks platform structure 24 and at the other end to pins mounted on the legs 26. As seen in FIG. 2 the brace 30, by means of a locking means 30A, serves as a brace to keep the legs 26 and 28 rigidly in a vertical position supported from the subbase by the pins 32 and 34.

The legs 26 and 28 of the drawworks platform extend along the ground away from a first end 16A of the subbase. The mast, indicated generally by the numeral 12, comprises four legs, two of which are shown 48A and 48B. The mast is attached by hinge pins 46 to the shoe 38 supported by the subbase. The pin 46 is at a selected distance above the ground surface 17. With the mast in this horizontal position and the back legs hinged at 46, the front legs 48B are at a selected small distance above the ground 17. This makes it very convenient for workmen to handle the various segments of the mast and to attach them together in preparation for raising the extended mast to a vertical position around the hinge pins 46.

At the top of the mast there is a conventional crown block structure 52 having sheaves 54, 55, 56, etc., which operate in a conventional manner and convert the tension in the fastline 50, which comes from the drum of the drawworks 44 to the travelling block 58, through cables 74 and between the various sheaves in the travelling block and the sheaves 54, 55 and 56 in the crown assembly.

The drawworks assembly 14 and the mast, except for the bottom pins of the four legs, and including the crown block assembly and the travelling block 58 and the hook 60, are all conventional. The subbase is preferably constructed in a U-shape manner with a principal middle section 16 and two parallel extending legs 16B, each of which are constructed in the form of a U cross-section. Thus in the position shown the front legs 48B will each be resting in the bottom cross-bar of the U. This will then, of course, provide the important low position of the mast on the ground and serve as a favorable work condition.

At a selected point near the bottom end of the mast is a pair of sheaves or pulleys 68 having a horizontal axis and a pair of sheaves or pulleys 66 having a vertical axis. There is also a third sheave or pulley 62 hanging on the hook 60 and free to rotate about a vertical pin.

Figure 7:
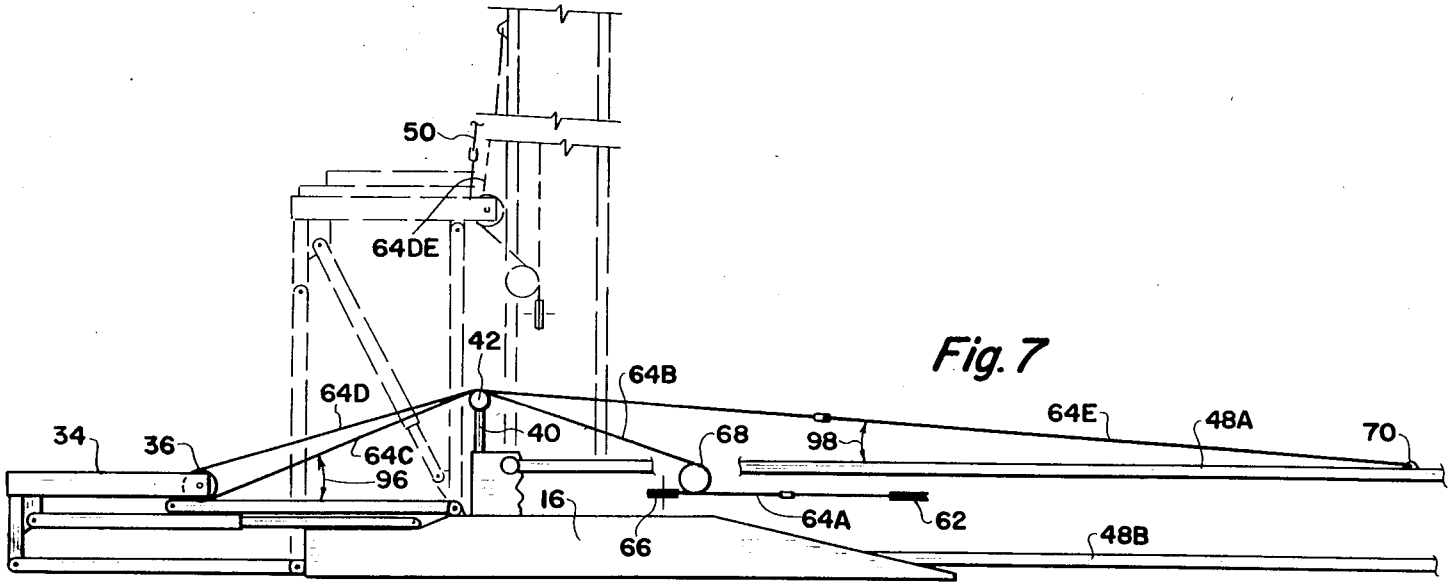

As shown in FIGS. 6 and 7 in which FIG. 6 is a plan view, third the sheave 62 is shown on the center line 94 of the mast and the subbase structure. The sheave 68 is also shown in a vertical plane and the sheave 66 in a horizontal plane. The slingline 64 is threaded through the third sheave 62, one end going to one side of the mast and the other going to the other side of the mast. The cable end 64A then passses around sheaves 66 and 68 and then over a pair of sheaves 42 mounted on posts 40, and then, as portions 64B and 64C, over fourth and fifth sheaves 42 mounted on first and second posts respectfully 40; then as 64C, 64D around first and second sheaves 36 mounted on the front side of the drawworks platform, as 64D back over the fourth and fifth sheaves 42, and as 64E the end is anchored at first and second anchor points 70 on the mast 12.

The post 40 that supports the sheaves 42 is required, so that the cables 64C, 64D attached around the sheave 26 will be pulled upward and sideward in order to lift the drawworks platform up into a vertical position supported on the hinge pins 32 and 34.

Figure 2B:
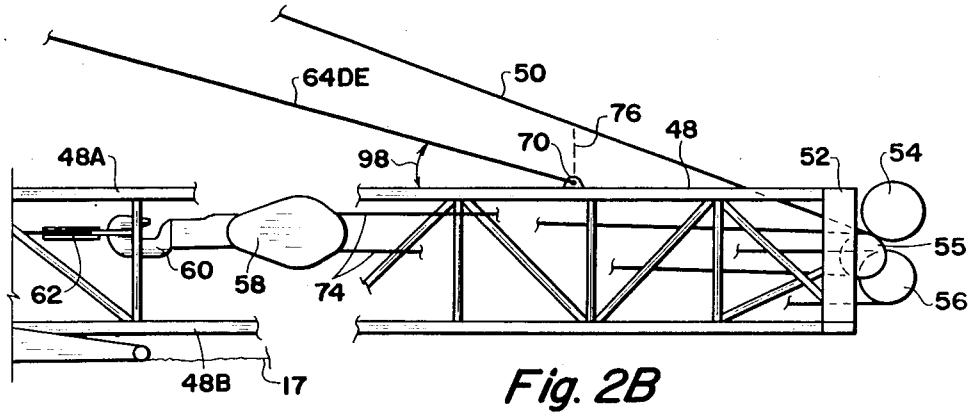
FIGS. 2A and 2B show in elevational view the system as in FIGS. 1A and 1B except that the drawworks platform has been lifted into a vertical position while the mast is still in its original horizontal position.
Figure 2A:
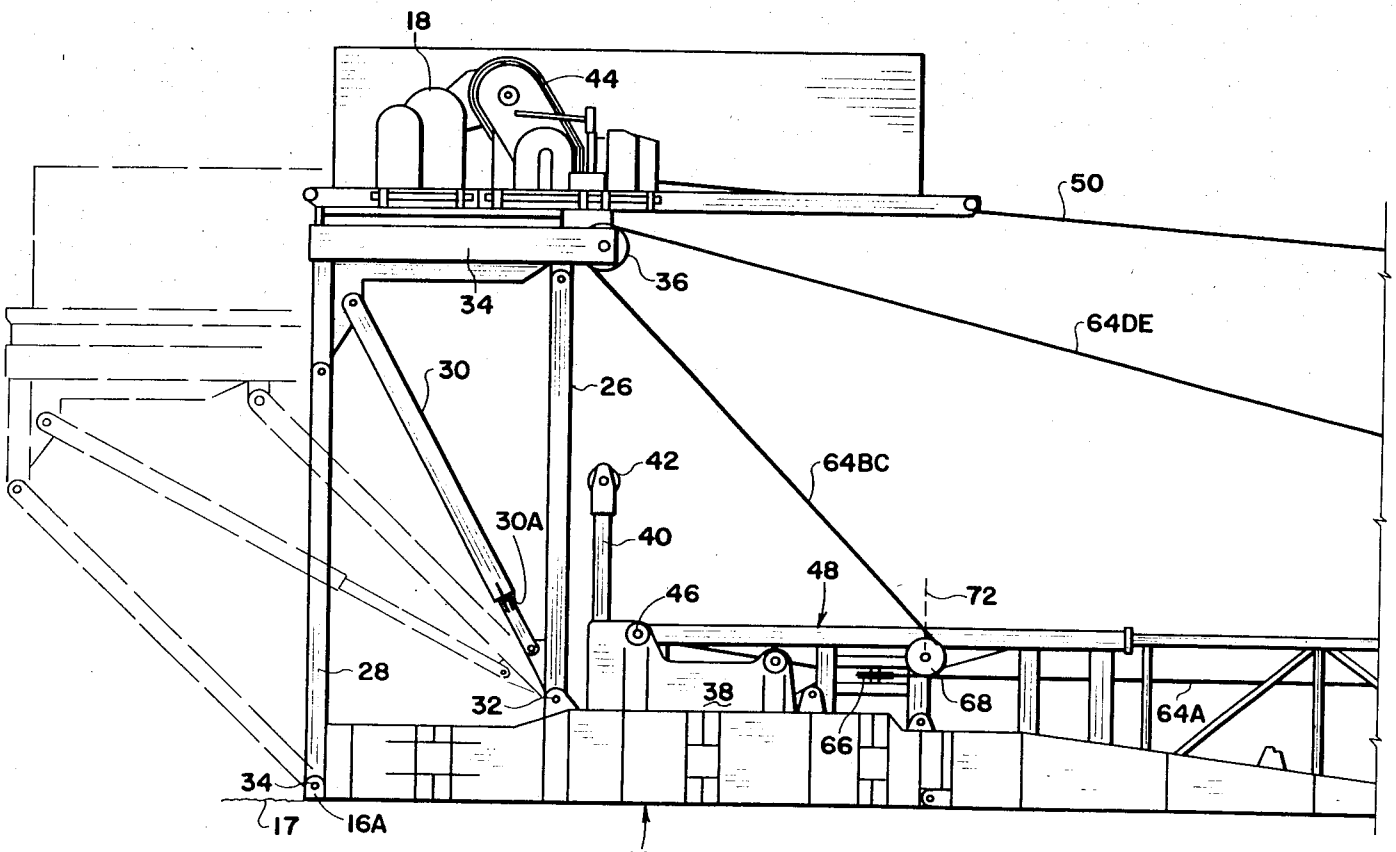

The process of raising the drawworks platform is illustrated in FIGS. 2A and 2B where the platform is in a mid-position as shown by the dashed line and in its final position as shown in the solid line. In that position, the brace 30 is locked at point 30A so that the length of that brace 30 will not change, and thus the drawworks platform will be in a rigid horizontal position.

The fastline 50 of the drawworks 14 by means of the crown sheaves and the travelling block sheaves lifts the travelling block 58. The hook 60 then pulls on the sheave 62, tightening the cables 64 and applying tension on the line segments 64D and 64E. As the pulling means (hook) 60 moves, it shortens the cable 64; and since the lifting angle 96 for the drawworks platform is greater than the slope angle of the cable end 64E, which is a smaller angle 98, the first part that will lift will be the drawworks platform. As it moves upwardly as shown in FIG. 2A, the cables 64B and 64C now are above the sheaves 42.

Figure 3:
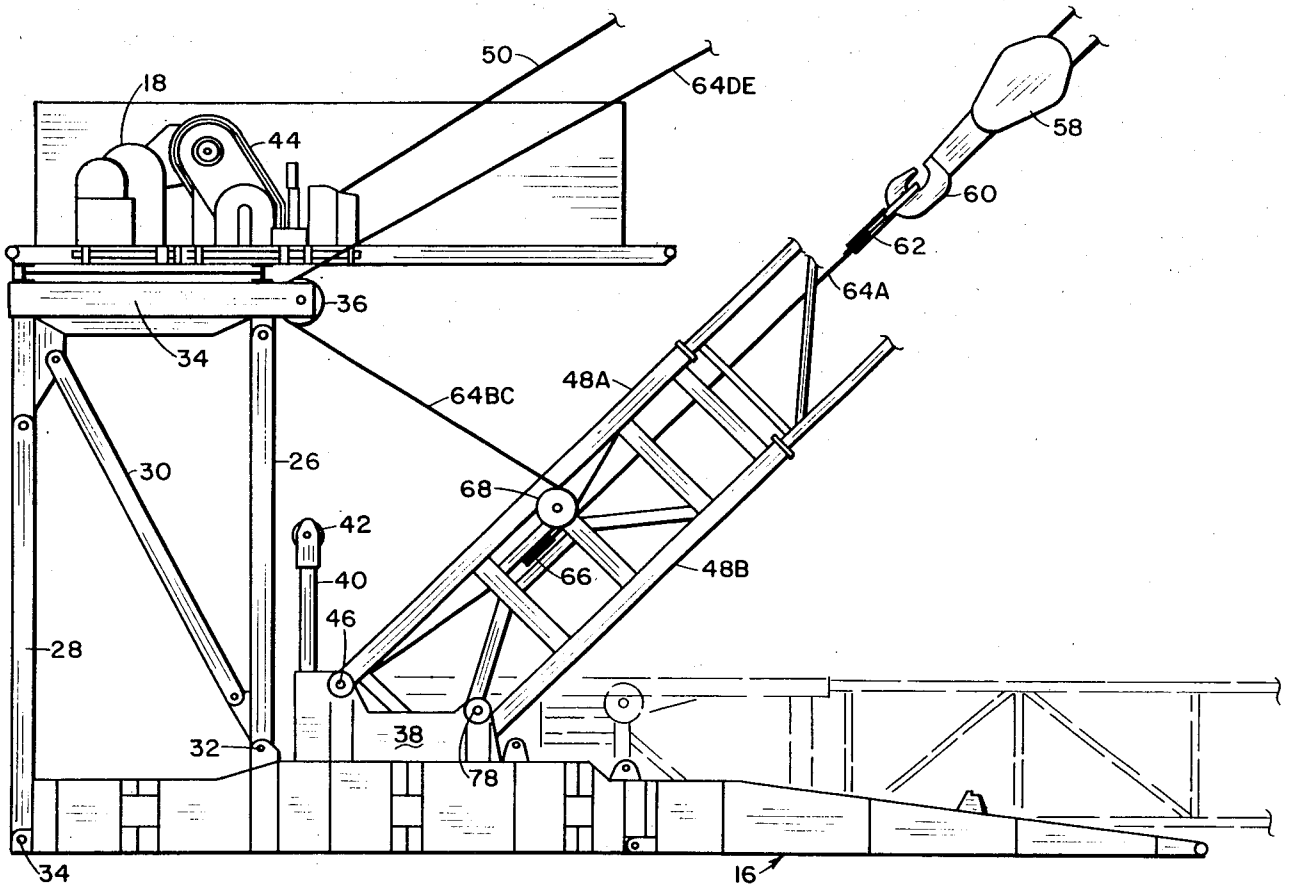
FIG. 3 illustrates the step of raising the mast into a vertical position.
Figure 4:
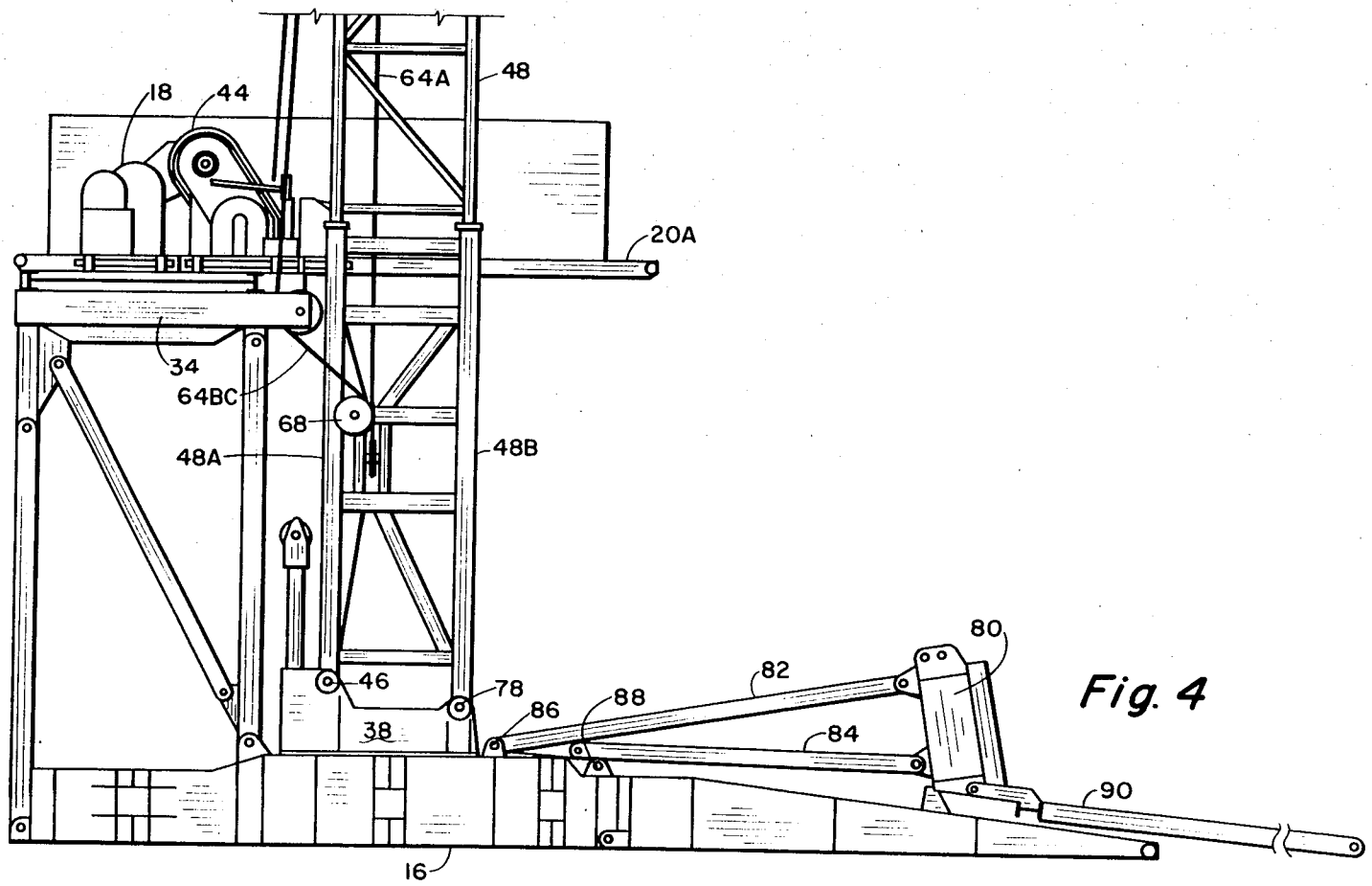
FIG. 4 illustrates in elevational view the subbase with the drawworks platform and mast raised into position and a setback platform which has been assembled on the base ready to be lifted into position.

As shown in FIGS. 2A and 2B with the drawworks platform raised, the angle 98 of the anchored end of the line 64E is large enough, particularly since there are two cables 64B, 64C, 64D, and 64E which are lifting the mast together at two positions 72 and 76. The mast will then begin to lift as the pulling means continues to move in the same direction until the mast is in a vertical position as shown in FIGS. 3 and 4. FIG. 3 shows the mast in partly raised position while 64 shows the mast in a fully raised position. In that position the front leg 48B can now be pinned at point 78 to the shoe 38. The mast now is supported on four legs 48A, 48B on each side, with four drive pins 46 and 78 respectively.

Figure 5:
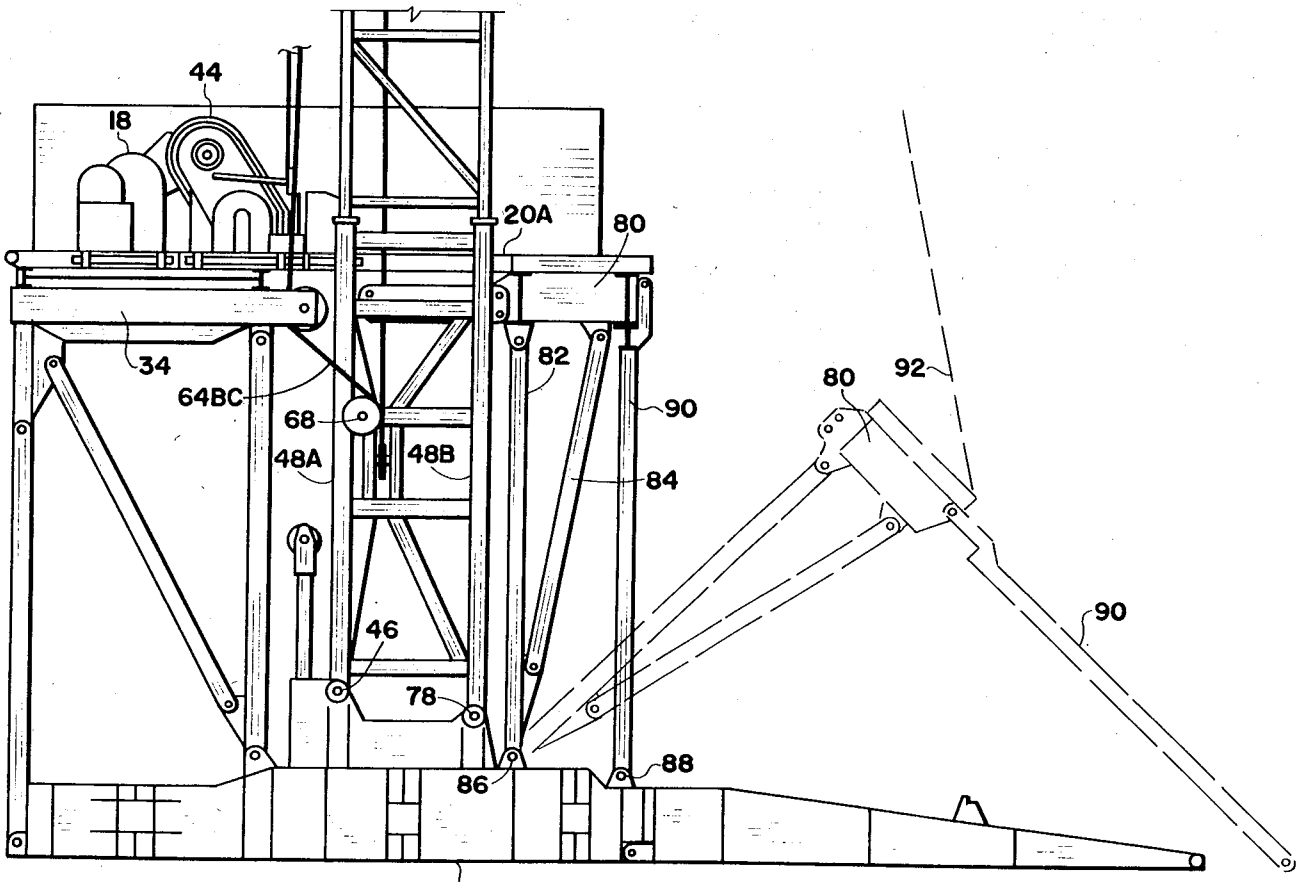
FIG. 5 illustrates the process of lifting the setback platform into position.

The next step in completing the assembly of the drilling system is to position the setback platform shown in FIGS. 4 and 5.

Once the mast is raised in position as in FIG. 4, there are then four pin points 86 and 88 available to which will be attached the four legs 82 and 84 of the setback platform 80. A cable 92 attached to the lifting means at one end is attached at its other end to the setback platform as shown in FIG. 5. By lifting the cable in a continuous motion around the pivots 86 to which two of the legs are attached, the setback platform is lifted into position as shown in FIG. 5. The front legs 90 are then pinned into the pivots 88. This provides, with the brace 84, a rigid vertical structure having a horizontal platform 80 which is aligned with the platform extension 20A shown in the previous drawings, as part of the drawworks platform.

The purpose of the setback platform 80 is to support the drill pipe that is to be lowered into the borehole. The process of drilling, of course, is conventional and forms no part of this invention.

As shown in FIG. 5, the drawworks platform 14 and the mast 12 are in vertical position, each supported on their four pins. The set-back platform is also raised and attached to the drawworks platform forming the complete work floor of the drilling system. No other detail of drilling apparatus such as rotary table and so on are shown at this time, since all of the drilling operations are conventional.

What has been described is a design of a drilling system in which the two principal parts of the drilling system; that is, the drawworks platform and the mast, are laid out on the ground and assembled to the subbase of the drilling system. The drawworks platform is attached by four legs hinged to the subbase structure but extending off a first end of the subbase while the mast is hinged at two points and extends off in the opposite direction beyond the second end of the subbase.

Using the drawworks fastline, the travelling block and hook become a pulling means by which a slingline cable is supported at its midpoint on a sheave carried by the pulling means. The two ends of the cable pass through suitable sheaves in planes on each side of the drilling system. The cable threads from a sheave on the side of the mast near the bottom, over a pair of sheaves on posts, to a pair of sheaves on opposite sides of the drawworks platform, and back to an anchor point on the mast. Thus, by a continuous pulling action, the drawworks platform is first raised into vertical position and locked in that position. Then by continuing the pulling operation, the mast is lifted by cable attachment to two points—one near the bottom, one near the top of the mast. The mast is then rotated into a vertical position using the drawworks platform as a point from which the pulling action takes place. When the mast is in the vertical position, all four legs are locked by drive pins to the base.

In this operation, of course, there is no need for cranes or A-frames or other means to lift the drawworks platform into position or for lifting the mast into position. The drawworks itself and the travelling block and crown block system are all that are needed to lift the two principal parts of the drilling system into vertical positions on the subbase structure.

While a slingline cable was shown supported by a sheave attached to the hook and each end going to appropriate sheaves on opposite sides of the mast and of the drawworks platform and while this is the preferred method, it would, of course, be possible to use a single cable attached to the pulling means along the center line plane of the drilling system and base to provide this lifting action.

Also, while the setback platform is shown as separately supported by four vertical legs attached to appropriate drive pins on the subbase structure, it will be seen that the setback platform can be hinged to the front legs of the platform and raised into position during the lifting of the mast. When the mast is partially lifted, appropriate braces can be attached between the outer edge of the setback platform and the front legs of the mast so that when the mast is in a vertical position the subbase will be horizontal and will be supported by the mast.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. A method of erecting a drawworks structure having four pivoted legs and a mast on a subbase structure wherein the drawworks structure in the unerected position and the mast in the unerected position are of substantially the same elevational height, comprising the steps of:

(1) erecting a subbase on the earth's surface;

(2) erecting an upright sheave post on said subbase structure between an unerected drawworks structure and an unerected mast, the sheave post having a sheave at the upper end thereof, the height of the sheave post being greater than the elevational height of the unerected drawworks structure and less than the height of drawworks structure in erected form;

(3) pivotally pinning the four pivoted legs of the unerected drawworks structure to the subbase, the drawworks structure having a platform thereon with drawworks mounted on the platform;

(4) pivotally pinning the lower end of the unerected mast to said subbase structure, the unerected mast extending horizontally away from said sheave post in the direction opposite said unerected drawworks structure;

(5) passing a line from said drawworks over said sheave post for connection to a pull point on said mast;

(6) using said drawworks to retract said line to pivot said drawworks structure upwardly into elevated, erected position above said subbase structure, the four legs of the drawworks platform extending vertically and adjacent to said sheave post; and (7) connecting said line to said mast and continuing to reel in said line on said drawworks to pivot said mast to the upright position adjacent said drawworks structure and adjacent said sheave post, said sheave post remaining in upright position entirely between and independent of said drawworks platform and said mast for use in diserecting said mast and drawworks structure.

* * * * *